US008265498B2

(12) United States Patent
Fan et al.

(10) Patent No.: US 8,265,498 B2
(45) Date of Patent: Sep. 11, 2012

(54) METHOD AND APPARATUS FOR DETERMINING MEDIA THICKNESS IN A FEEDER SECTION OF AN IMAGE PRODUCTION DEVICE

(75) Inventors: Zhigang Fan, Webster, NY (US); Michael D. Borton, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 592 days.

(21) Appl. No.: 12/510,726

(22) Filed: Jul. 28, 2009

(65) Prior Publication Data

US 2011/0026059 A1 Feb. 3, 2011

(51) Int. Cl.
*G03G 15/00* (2006.01)

(52) U.S. Cl. ..... 399/45; 399/389

(58) Field of Classification Search ..... 399/45, 399/389

See application file for complete search history.

(56) References Cited

U.S. PATENT DOCUMENTS 6,823,148 B2 * 11/2004 Weaver et al. ..... 399/23
7,831,160 B2 * 11/2010 Murakami ..... 399/45
8,023,843 B2 * 9/2011 DeGruchy et al. ..... 399/45

OTHER PUBLICATIONS

Paul J. DeGruchy et al.; "Method and Apparatus for Media Thickness Measurement in an Image Production Device"; U.S. Appl. No. 12/261,463, filed Oct. 30, 2008.

* cited by examiner

*Primary Examiner* — David Gray
*Assistant Examiner* — Gregory H Curran
(74) *Attorney, Agent, or Firm* — Ronald E. Prass, Jr.; Prass LLP

(57) ABSTRACT

A method and apparatus for determining media thickness in a feeder section of an image production device is disclosed. The method may include receiving one or more multi-dimensional images of a media stack from an imaging device, the media stack including one or more media clips that each contain a plurality of media sheets, deriving a multi-dimensional feature signal from the received one or more multi-dimensional images, converting the derived multi-dimensional feature signal to a one-dimensional feature signal, estimating media clip thickness using the one-dimensional signal, estimating media sheet thickness using the estimated media clip thickness, and adjusting at least one image production device parameter based on the estimated media sheet thickness.

21 Claims, 7 Drawing Sheets

610

620

METHOD AND APPARATUS FOR DETERMINING MEDIA THICKNESS IN A FEEDER SECTION OF AN IMAGE PRODUCTION DEVICE

BACKGROUND

Disclosed herein is a method for determining media thickness in an image production device, as well as the corresponding apparatus and computer-readable medium.

One of the most important media properties that impact overall performance of an image production device is media thickness. Media thickness is a major variable that determines optimal parameters for feeding, image transfer and fusing within xerographic systems and affects print head gaps for direct marking systems. When media thickness is known, each subsystem can adjust their parameters to optimize for that thickness.

Most conventional image production devices rely on the operator entering the media type when loading the media tray. In an office environment, this information may not be accurate if it relies upon a casual operator's input. Other conventional image production devices measure media thickness within a paper transport. However, this information is only available after feeding and often provided too late for other subsystems to perform corrective action.

SUMMARY

A method and apparatus for determining media thickness measurement in a feeder section of an image production device is disclosed. The method may include receiving one or more multi-dimensional images of a media stack from an imaging device, the media stack including one or more media clips that each contain a plurality of media sheets, deriving a multi-dimensional feature signal from the received one or more multi-dimensional images, converting the derived multi-dimensional feature signal to a one-dimensional feature signal, estimating media clip thickness using the one-dimensional signal, estimating media sheet thickness using the estimated media clip thickness, and adjusting at least one image production device parameter based on the estimated media sheet thickness.

DETAILED DESCRIPTION

Figure 1:
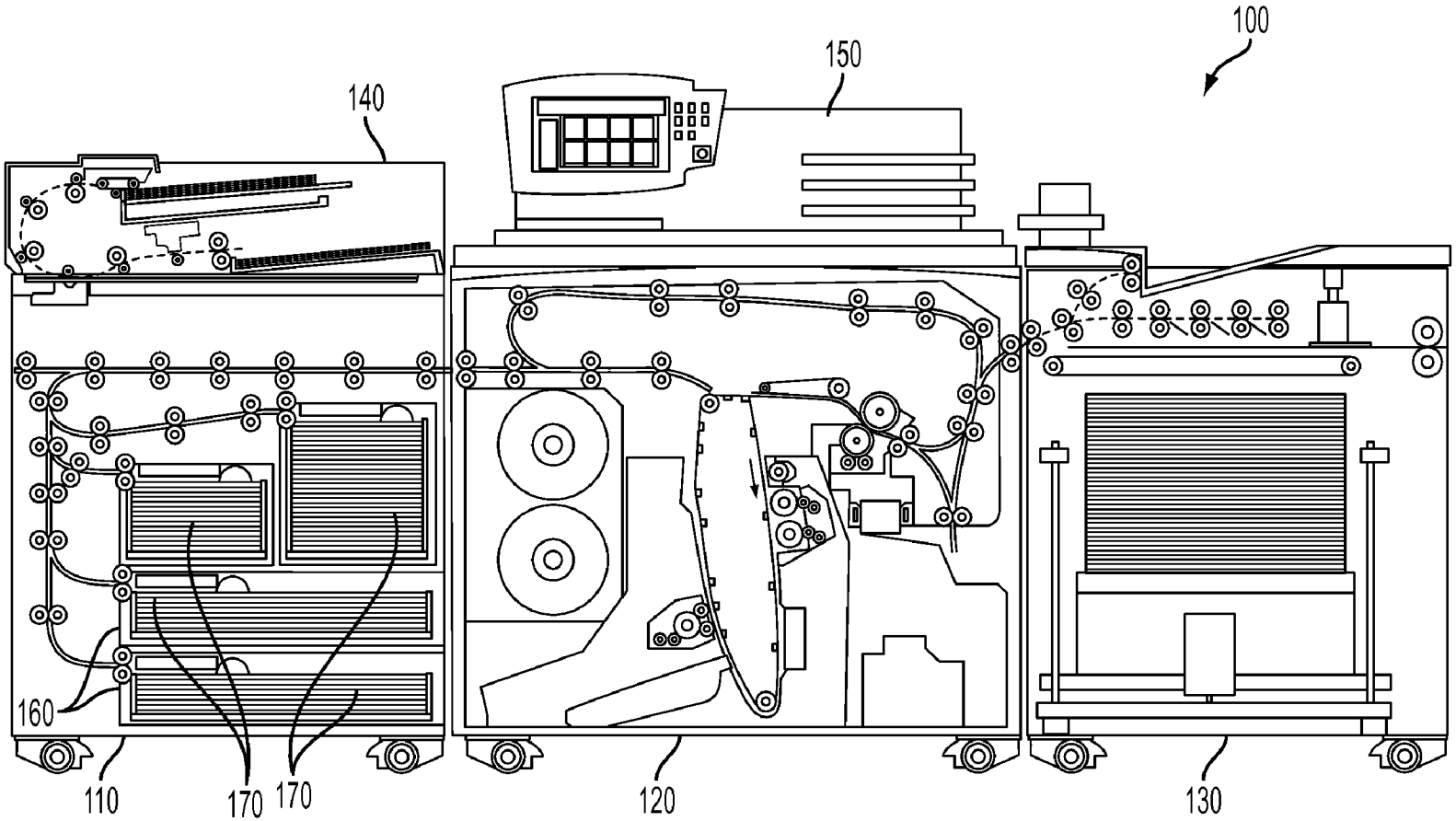
FIG. 1 is an exemplary diagram of an image production device in accordance with one possible embodiment of the disclosure.

Aspects of the embodiments disclosed herein relate to a method for determining media thickness in a feeder section of an image production device, as well as corresponding apparatus and computer-readable medium.

The disclosed embodiments may include a method for determining media thickness in a feeder section of an image production device. The method may include receiving one or more multi-dimensional images of a media stack from an imaging device, the media stack including one or more media clips that each contain a plurality of media sheets, deriving a multi-dimensional feature signal from the received one or more multi-dimensional images, converting the derived multi-dimensional feature signal to a one-dimensional feature signal, estimating media clip thickness using the one-dimensional signal, estimating media sheet thickness using the estimated media clip thickness, and adjusting at least one image production device parameter based on the estimated media sheet thickness.

The disclosed embodiments may further include an image production device having a feeder section that may include an imaging device that provides multi-dimensional images of a media stack, wherein the media stack includes one or more media clips that each contain a plurality of media sheets, and a media thickness determination unit that receives one or more multi-dimensional images of a media stack from the imaging device, derives a multi-dimensional feature signal from the received one or more multi-dimensional images, converts the derived multi-dimensional feature signal to a one-dimensional feature signal, estimates media clip thickness using the one-dimensional signal, estimates media sheet thickness using the estimated media clip thickness, and adjusts at least one image production device parameter based on the estimated media sheet thickness.

The disclosed embodiments may further include a computer-readable medium storing instructions for controlling a computing device for determining media thickness in a feeder section of an image production device. The instructions may include receiving one or more multi-dimensional images of a media stack from an imaging device, the media stack including one or more media clips that each contain a plurality of media sheets, deriving a multi-dimensional feature signal from the received one or more multi-dimensional images, converting the derived multi-dimensional feature signal to a one-dimensional feature signal, estimating media clip thickness using the one-dimensional signal, estimating media sheet thickness using the estimated media clip thickness, and adjusting at least one image production device parameter based on the estimated media sheet thickness.

To alleviate these problems, the disclosed embodiments may concern automatically determining the media thickness in the feeder input stack tray of an image production device. This process may include using a low cost multi-dimensional imaging device, such as a two-dimensional (2D) imaging device (e.g., a camera) with an inexpensive plastic lens, to look at the side of the media stack, process the resulting image, and determine the media thickness of the stack.

The 2D imager may include self-contained Light Emitting Diode (LED) illumination and the lens can have a fixed focal length and be focused by spring loading the device against the stack. The imager may be fairly low resolution since it may use a lens to look at a small area of approximately 2×2 mm. In this manner, there may be more pixels per sheet even with a low pixel density imager, (2×2=approximately 20 sheets of 75 gsm media). For example, a 420×480 pixel imager viewing a 1.75×2 mm area may yield around 24 pixels per sheet for 75 gsm media. The media thickness determination unit may discriminate the image to find the sheet-to-sheet interfaces and accurately measure the media thickness. Since the two-dimensional imager may capture many sheet interfaces and a sectional length across each sheet, even poorly cut media reams may be measured by applying a dynamic band pass filter around the measured moving average of the number of pixels between the sheet interfaces.

One of the advantages of this process is that it may provide for automated upfront media information prior to cycle up and feeding of any sheets. Thus, the process may allow for set point adjustments of feeder parameters, head gaps and fuser temperature where instantaneous responses cannot be achieved when measured in downstream transports.

The process of the disclosed embodiments may include:

1. First estimating the media clip thickness and then the media sheet thickness. Since the clip and sheet signals may have significant difference in strength, separating them in two stages may prevent the weak sheet signal from being overwhelmed by the strong clip signal. In addition, the detected media clip thickness effectively limits the search space for media sheet thickness estimation, thus making the latter more robust and accurate.
2. Feature characteristics may be extracted for each pixel, which not only reflects its brightness or darkness, but also its texture (roughness). This enables robust detection of sheet interfaces that appear in various forms.
3. Instead locating peaks in the image feature's profile, peaks in the autocorrelation function are detected. This enhances signal to noise ratio, and results in a more reliable and accurate estimation.
4. Each line of the signal may be aligned before performing averaging.

The knowledge of media thickness provides important information for a printing system to optimize various parameters of its subsystems. After capturing images of a media stack in the feeder's input stack tray using the low cost 2-D camera, the 2-D image may then be averaged in one direction to generate a 1-D profile. The interfaces between the media sheets may be detected as the darker peaks in the profile, and the media sheet thickness may be estimated from the most dominant distance between the detected neighboring sheet interfaces.

The media stack is usually composed of "media clips" and each media clip may contain several media sheets in the media stack between the two perceptible media clip boundaries. The number of sheets per media clip may vary for different kinds of papers and may not be known a priori. For these difficult images, the interfaces between sheets can often hardly be seen. On the contrary, the interfaces between the clips are usually readily visible.

The following observations for the images captured from the media stack, particularly for the "difficult" images:

1. The interfaces between the clips are typically readily visible, while the interfaces between sheets in some cases can hardly be seen.
2. Although the interfaces between sheets are dominantly darker, it is not always the case. In some instances, they can be: 1) brighter; 2) noisier (brighter in some spots and darker in other spots); or 3) on an edge (left side and right side have relatively large brightness differences.
3. The sheets within a clip may appear to have different thickness.
4. Sheets may not have perfect alignment in the vertical direction.

Based on the above observations, the process of the disclosed embodiments is proposed and may be conceptually composed of four steps. 1) A 2-D feature signal may be derived from the image, which may reflect both brightness/darkness and texture (roughness). 2) The 2-D feature may be converted to 1-D by alignment and averaging. 3) The thickness of clips may be estimated as the peak of the autocorrelation function of the 1-D feature. 4) The sheet thickness may be estimated as an optimization process that maximizes the relative autocorrelation.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hardcopy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module includes any number of trays 160, each of which stores a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media are advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more images thereon. Then, the printed sheet is then moved to output section 130, where it may be collated, stapled, folded, etc., with other media sheets in manners familiar in the art.

Figure 2:
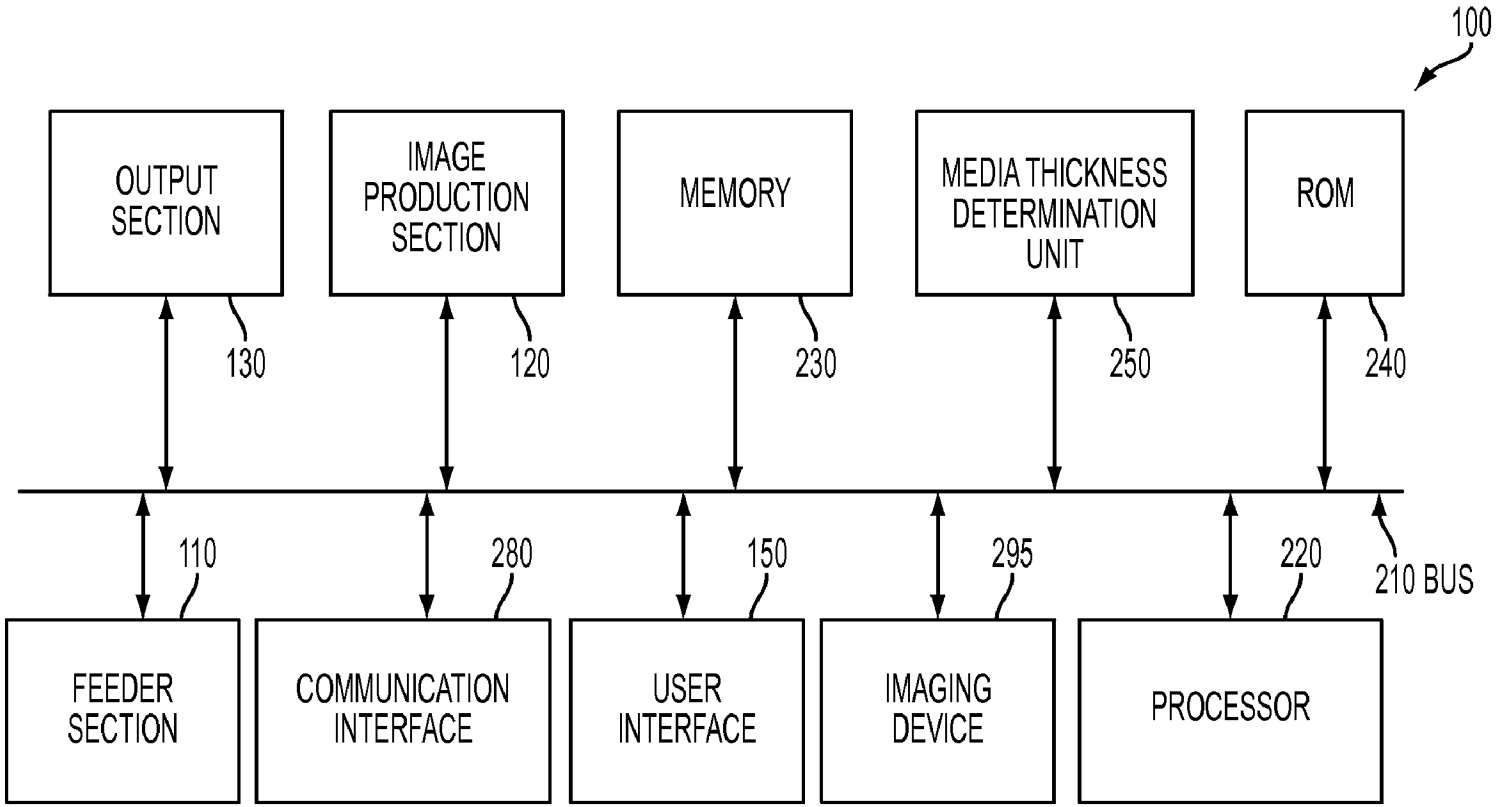
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM 240, a media thickness determination unit 250, a feeder section 110, an output section 130, a user interface 150, a communication interface 280, an image production section 120, and an imaging device 295. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example.

The imaging device 295 may provide images of a media stack for analysis. The imaging device 295 may be any imaging device that may provide images for analysis, including a two-dimensional camera or other multi-dimensional camera, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
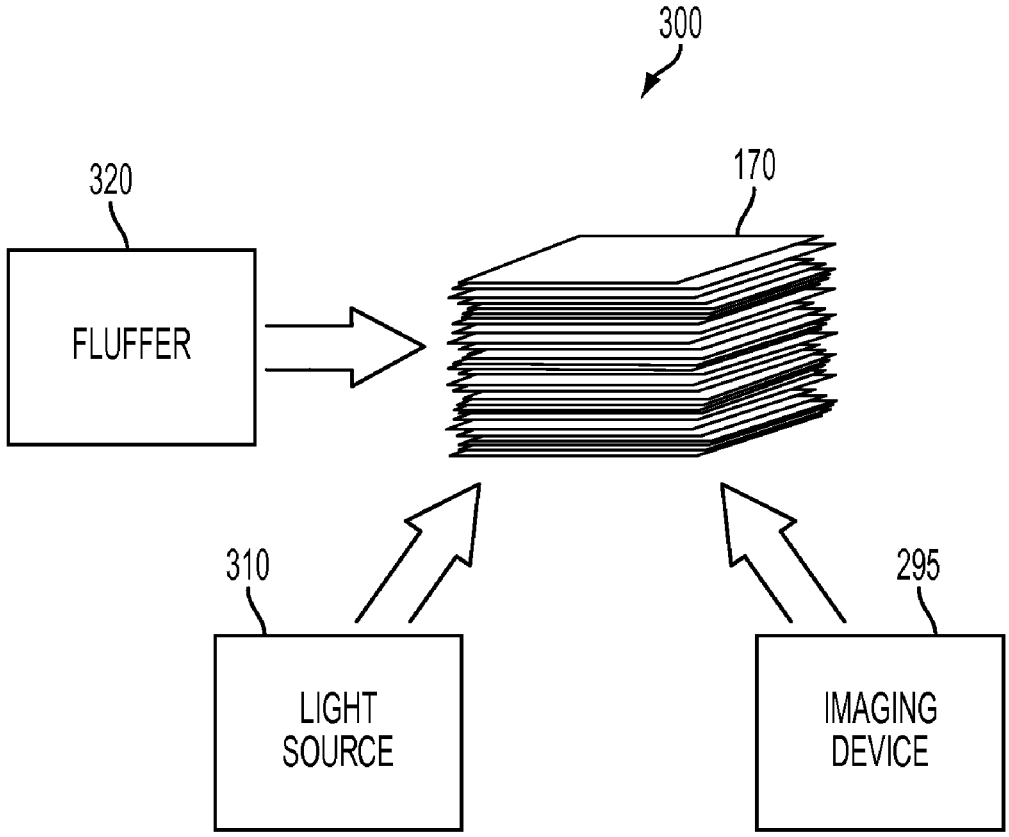
FIG. 3 is a exemplary block diagram of the media thickness measurement environment in accordance with one possible embodiment of the disclosure.

FIG. 3 is an exemplary block diagram of the media thickness measurement environment 300 in accordance with one possible embodiment of the disclosure. The media thickness measurement environment 300 may be found in the feeder section 110 and may include a light source 310, a fluffer 320, and the imaging device 295 directed at a media stack 170. While the term a media stack 170 is used for ease of discussion, the media stack 170 may represent any type of media used to produce documents in the image production device 100, such as any type of paper, plastic, photo paper, cardboard, etc.

The light source 310 may be any source that gives off light and illuminates the media stack to assist the imaging device 295 in obtaining an image, such as a light emitting diode, a bulb, etc. The imaging device 295 may be a two-dimensional camera or the like that may provide images of a media stack for analysis, for example. The fluffer 320 may represents any device that separates the media sheets, such as a fluffer, air knife, vacuum grip, etc. For example, a fluffer 320 may blow air onto the edge of a media stack 170 to create separation between the media sheets in order to avoid jamming of the image production device 100.

The operation of components of the media thickness determination unit 250 and the media thickness determination process will be discussed in relation to the flowchart in FIG. 4.

Figure 4:
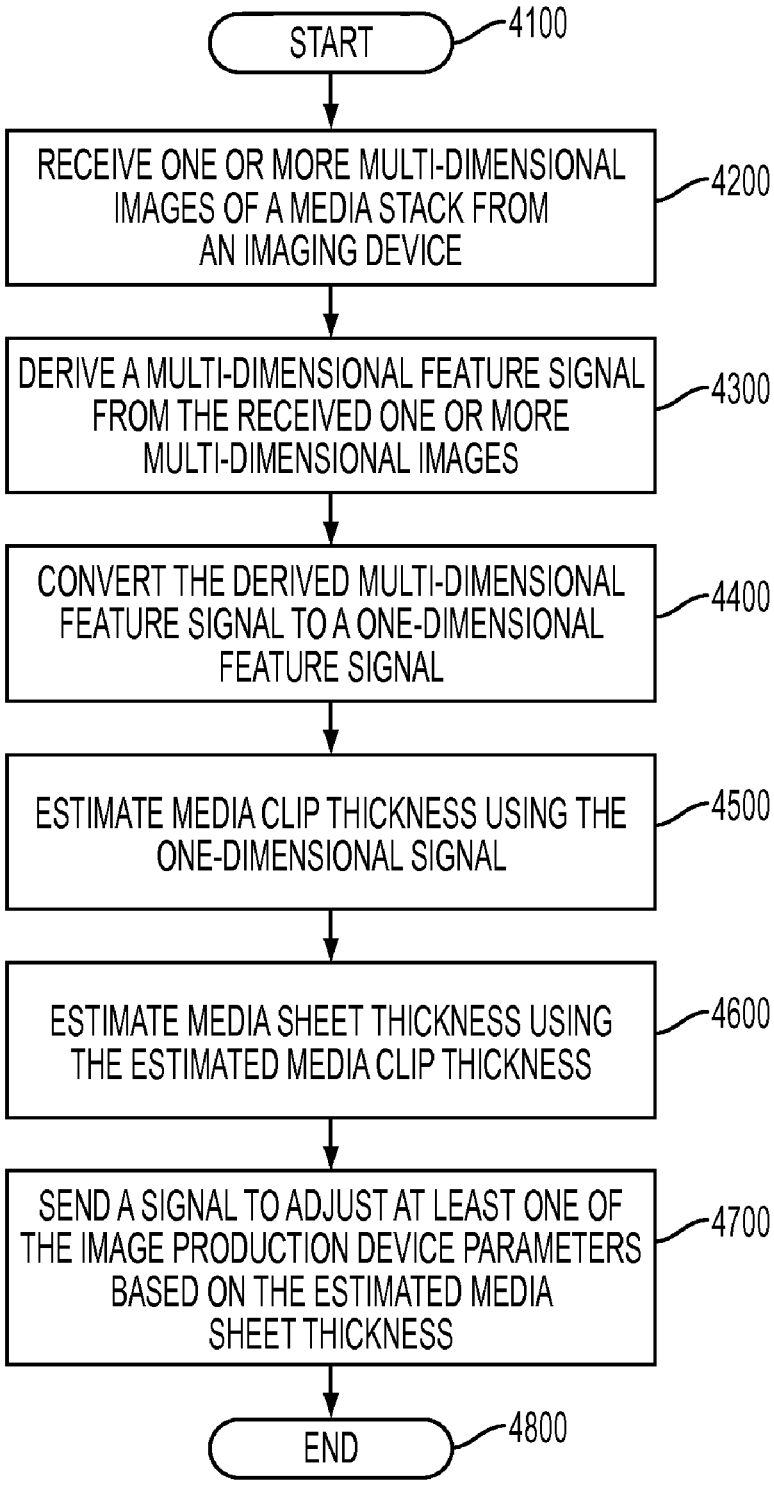
FIG. 4 is a flowchart of an exemplary media thickness measurement process in accordance with one possible embodiment of the disclosure.

FIG. 4 is a flowchart of a media thickness measurement process in accordance with one possible embodiment of the disclosure. The method begins at 4100, and continues to 4200 where the media thickness determination unit 250 may receive multi-dimensional images of the media stack 170 from the imaging device 295. The media stack 170 may include one or more media clips that each contain a plurality of media sheets, for example.

Figure 5A:
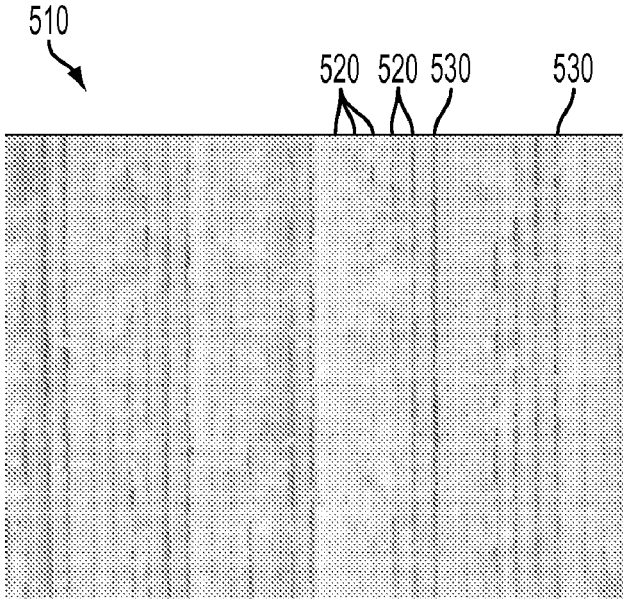
FIGS. 5A and 5B are exemplary images of a media stack in accordance with one possible embodiment of the disclosure.
Figure 5B:
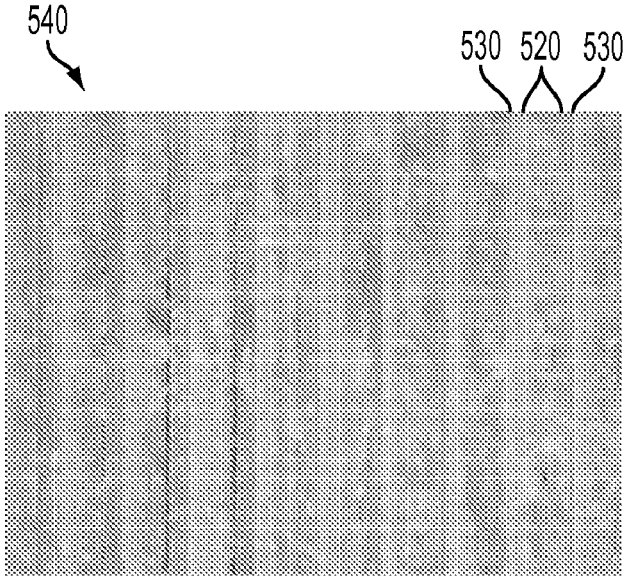

FIGS. 5A and 5B show exemplary two-dimensional images of the image stack 170 that may be provided to the media thickness determination unit 250 for processing. As shown from the imaged media stack 170, the media clip and media sheet-to-sheet interfaces (or resulting contrast between the sheet area and the darkened area between the sheets) are generally identifiable in the image. FIG. 5A shows an image of the media clip interfaces 530 and the media sheet interfaces 520 in which there are 6 sheets per media clip. The media clip interfaces 530 tend to appear darker and more pronounced than the media sheet interfaces 520. FIG. 5B shows an image of the media clip interfaces 530 and the media sheet interfaces 520 where there are 3 sheets per media clip.

At step 4300, the media thickness determination unit 250 may derive a multi-dimensional feature signal from the received one or more multi-dimensional images. For example, the media thickness determination unit 250 may derive the multi-dimensional feature signal using high pass one-dimensional filtering and a feature function which represents pixel brightness/darkness and texture.

In particular, a 2-D feature signal may be derived from the image, which enables robust detection of sheet interfaces that appear in various forms. 1D horizontal) high pass filtering may be performed first to reduce low-frequency fluctuation. The feature signal may be evaluated as discussed above:

$$f(x,y)=h(x,y)-ch^2(x,y) \quad (1)$$

where f(x) and h(x) are the feature signal and high-pass filtered result at pixel x, respectively. The input image value is assumed to be normalized to the range of [0, 255] and 0 and 255 represents the darkest (brightest) values respectively. The first term in equation (1) may reflect the pixel brightness/darkness while the second term may represent high-frequency energy (roughness). Weighting constant c is selected to be 1 in the experiments discussed below. The smaller the value of f(x, y), the more likely it is located on the sheet (and clip) interface. Obviously, equation (1) may be able to handle dark interfaces as well as all three other kinds of interfaces listed in our observation above. The feature may be biased towards darker interfaces which is consistent with the fact that darker interfaces appear more frequently than brighter ones.

At step 4400, the media thickness determination unit 250 may convert the derived multi-dimensional feature signal to a one-dimensional feature signal. For example, the media thickness determination unit 250 may convert the derived multi-dimensional feature signal to a one-dimensional feature signal by line-by-line alignment to maximize cross correlation and averaging the aligned lines in the vertical direction. In particular, the 2-D feature evaluated from the derivation step may be aligned line-by-line by maximizing cross line correlation. The maximum shift relative to the previous line may be ±1. The aligned lines may be averaged in the vertical direction to produce a 1-D feature signal F(x).

At step 4500, the media thickness determination unit 250 may estimate the media clip thickness using the one-dimensional signal. For example, the media thickness determination unit 250 may estimate the media clip thickness by calculating an autocorrelation function and using its maximum peak reading. In particular, the autocorrelation function may be calculated for F(x), and its peak lag with the maximum reading (outside of the main lobe) may be used as the estimation of the clip thickness. There may be several peaks with similar heights (clip interfaces may look similar to sheet interfaces in the image, or in the feature signal) and clip thickness may not be reliably detected. However, as long as the highest peak corresponds to the multiple of the sheet thickness (this is almost always the case), the sheet thickness may still be estimated correctly. In other words, the clip thickness might be wrong, but it does not have any impact on sheet thickness estimation.

At step 4600, the media thickness determination unit 250 may estimate the media sheet thickness using the estimated media clip thickness. For example, the media thickness determination unit 250 may estimate the media sheet thickness by using the calculated autocorrelation function, the estimated media clip thickness, and a known maximum number of media sheets per media clip.

In particular, the sheet thickness may not be estimated directly. Rather, the number of sheets contained in each clip may be determined. As observed, sheets may appear having different thickness in the images, and in many cases the border between sheets are not clearly defined. As a result, determining the number of sheets N for each clip may effectively reduce search space and provide more reliable and accurate results. In addition, the process may also save computation. N may be calculated to maximize the relative autocorrelation function. More specifically:

$$N=\mathrm{ArgMax}_i ac[\mathrm{clip_thick}/i] \text{ for } i=1, 2, \ldots, \mathrm{Max_}N \quad (2)$$

where ac (.) may be the auto-correlation evaluated in the last step, clip_thick may be the estimated clip thickness obtained in the last step, and Max_N may be the maximum number of sheets per clip known a priori. The maximization may also be further constrained by the knowledge of the minimum and maximum thickness of the media. Once N is evaluated, the (average sheet thickness) may be simply calculated as sheet_thick=clip_thick/N.

At step 4700, the media thickness determination unit 250 may send a signal to adjust at least one of the image production device parameters based on the estimated media sheet thickness. An image production device parameter may be any parameter that may be adjusted according to the determined media thickness to optimize the feeding of documents in the image production device 100. These image production device parameters and include feeder parameters and fuser temperature.

Feeder parameters may include the feeder vacuum pressure, air knife blower pressure, etc., for example. The feeder vacuum pressure and the air knife blower pressure may be adjusted higher for media thicknesses that are heavier than the thickness of standard paper and adjusted lower for media thicknesses that are thinner than the thickness of standard paper, for example. The fuser temperature may be adjusted higher for media thicknesses that are heavier than the thickness of standard paper and adjusted lower for media thicknesses that are thinner than the thickness of standard paper. The process may then go to step 4800 and end.

Figure 6A:
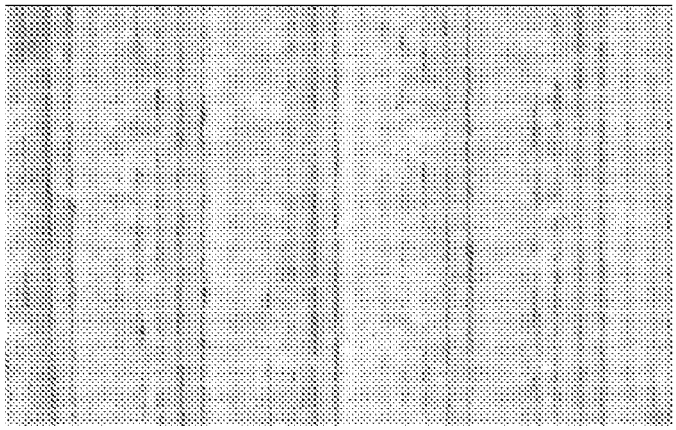
FIGS. 6A-6C are exemplary images and a graph illustrating the media thickness measurement process in accordance with one possible embodiment of the disclosure.
Figure 6B:
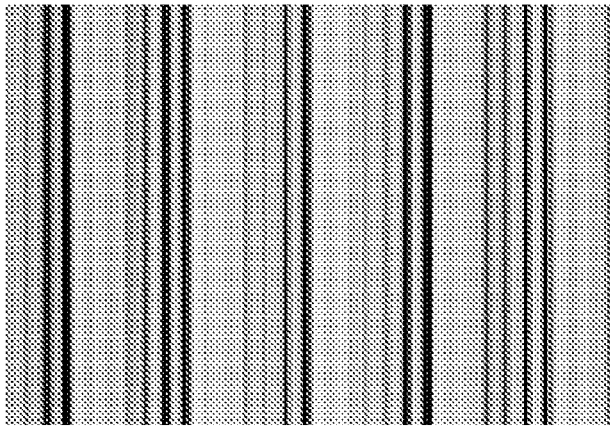
Figure 6C:
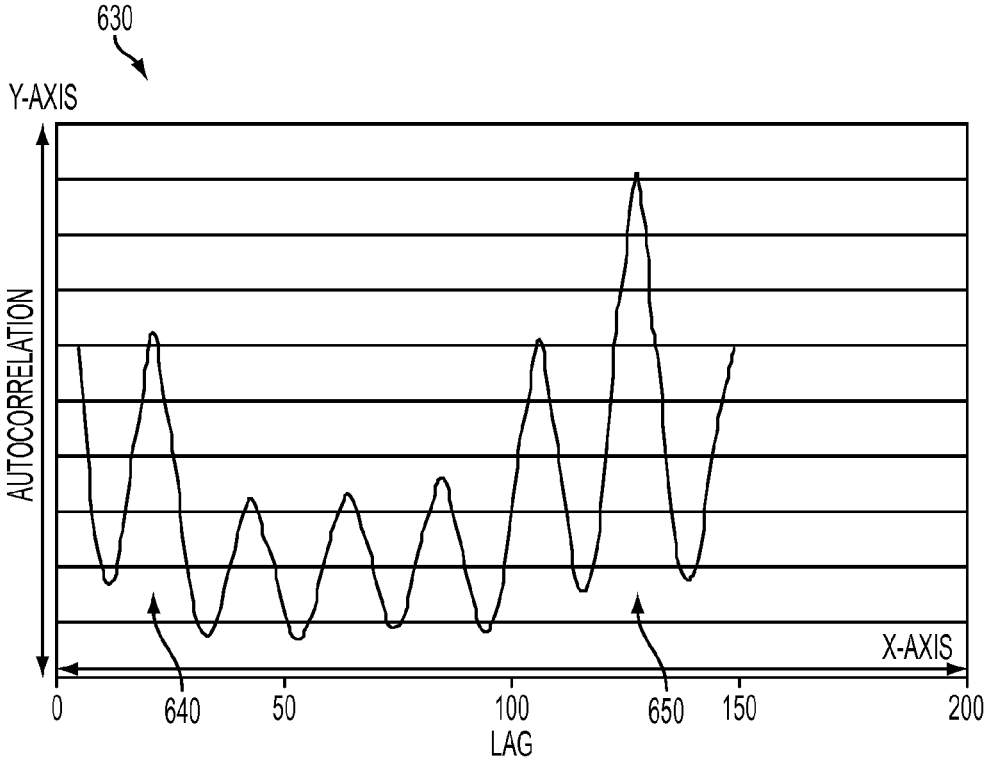

FIGS. 6A-6C are exemplary images and a graph illustrating the media thickness measurement process in accordance with one possible embodiment of the disclosure. FIG. 6A is the input image, FIG. 6B is the feature signal F(x) obtained after first two steps of processing, and FIG. 6C is the autocorrelation function of F(x). F(x) is a 1-D signal. It is expanded in FIG. 6B in vertical direction to make it more easily comparable with FIG. 6A. The detected media clip thickness N, and the media sheet thickness are also marked as 650 and 640 respectively in FIG. 6C.

The detection results are consistent with the physical measurements. For example, in FIG. 6A-6C, the estimation results in the media clip thickness=128 (650), N=6, and the media sheet thickness=21 (640). The true (measured) sheet thickness=20-22.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for determining media thickness in a feeder section of an image production device, comprising:

receiving one or more multi-dimensional images of a media stack from an imaging device, the media stack including one or more media clips that each contain a plurality of media sheets;

deriving a multi-dimensional feature signal from the received one or more multi-dimensional images;

converting the derived multi-dimensional feature signal to a one-dimensional feature signal;

estimating media clip thickness using the one-dimensional signal;

estimating media sheet thickness using the estimated media clip thickness; and adjusting at least one image production device parameter based on the estimated media sheet thickness.

2. The method of claim 1, wherein the multi-dimensional feature signal is derived using high pass one-dimensional filtering and a feature function which represents pixel brightness/darkness and texture.

3. The method of claim 1, wherein the derived multi-dimensional feature signal is converted to a one-dimensional feature signal by line-by-line alignment to maximize cross correlation and averaging the aligned lines in the vertical direction.

4. The method of claim 1, wherein the media clip thickness is estimated by calculating an autocorrelation function and using its maximum peak reading.

5. The method of claim 4, wherein the media sheet thickness is estimated by using the calculated autocorrelation function, the estimated media clip thickness, and a known maximum number of media sheets per media clip.

6. The method of claim 1, wherein the at least one image production device parameter is at least one feeder parameter and at least one feeder parameter is at least one of feeder vacuum pressure and air knife blower pressure, and at least one of the feeder vacuum pressure and the air knife blower pressure are adjusted higher for media thicknesses that are heavier than the thickness of standard paper and adjusted lower for media thicknesses that are thinner than the thickness of standard paper.

7. The method of claim 1, wherein the image production device is one of a copier, a printer, a facsimile device, and a multi-function device.

8. An image production device having a feeder section, comprising:

an imaging device that provides multi-dimensional images of a media stack, wherein the media stack includes one or more media clips that each contain a plurality of media sheets; and a media thickness determination unit that receives one or more multi-dimensional images of a media stack from the imaging device, derives a multi-dimensional feature signal from the received one or more multi-dimensional images, converts the derived multi-dimensional feature signal to a one-dimensional feature signal, estimates media clip thickness using the one-dimensional signal, estimates media sheet thickness using the estimated media clip thickness, and adjusts at least one image production device parameter based on the estimated media sheet thickness.

9. The image production device of claim 8, wherein the media thickness determination unit derives the multi-dimensional feature signal using high pass one-dimensional filtering and a feature function which represents pixel brightness/darkness and texture.

10. The image production device of claim 8, wherein the media thickness determination unit converts the derived multi-dimensional feature signal to a one-dimensional feature signal by line-by-line alignment to maximize cross correlation and averaging the aligned lines in the vertical direction.

11. The image production device of claim 8, wherein the media thickness determination unit estimates the media clip thickness by calculating an autocorrelation function and using its maximum peak reading.

12. The image production device of claim 11, wherein the media thickness determination unit estimates the media sheet thickness by using the calculated autocorrelation function, the estimated media clip thickness, and a known maximum number of media sheets per media clip.

13. The image production device of claim 8, wherein at least one image production device parameter at least one feeder parameter and the at least one feeder parameter is at least one of feeder vacuum pressure and air knife blower pressure, and at least one of the feeder vacuum pressure and the air knife blower pressure are adjusted higher for media thicknesses that are heavier than the thickness of standard paper and adjusted lower for media thicknesses that are thinner than the thickness of standard paper.

14. The image production device of claim 8, wherein the image production device is one of a copier, a printer, a facsimile device, and a multi-function device.

15. A non-transitory computer-readable medium storing instructions for controlling a computing device for determining media thickness in a feeder section of an image production device, the instructions comprising:

receiving one or more multi-dimensional images of a media stack from an imaging device, the media stack including one or more media clips that each contain a plurality of media sheets;

deriving a multi-dimensional feature signal from the received one or more multi-dimensional images;

converting the derived multi-dimensional feature signal to a one-dimensional feature signal;

estimating media clip thickness using the one-dimensional signal;

estimating media sheet thickness using the estimated media clip thickness; and adjusting at least one image production device parameter based on the estimated media sheet thickness.

16. The non-transitory computer-readable medium of claim 15, wherein the multi-dimensional feature signal is derived using high pass one-dimensional filtering and a feature function which represents pixel brightness/darkness and texture.

17. The non-transitory computer-readable medium of claim 15, wherein the derived multi-dimensional feature signal is converted to a one-dimensional feature signal by line-by-line alignment to maximize cross correlation and averaging the aligned lines in the vertical direction.

18. The non-transitory computer-readable medium of claim 15, wherein the media clip thickness is estimated by calculating an autocorrelation function and using its maximum peak reading.

19. The non-transitory computer-readable medium of claim 18, wherein the media sheet thickness is estimated by using the calculated autocorrelation function, the estimated media clip thickness, and a known maximum number of media sheets per media clip.

20. The non-transitory computer-readable medium of claim 15, wherein the at least one image production device parameter is at least one feeder parameter and at least one feeder parameter is at least one of feeder vacuum pressure and air knife blower pressure, and at least one of the feeder vacuum pressure and the air knife blower pressure are adjusted higher for media thicknesses that are heavier than the thickness of standard paper and adjusted lower for media thicknesses that are thinner than the thickness of standard paper.

21. The non-transitory computer-readable medium of claim 15, wherein the image production device is one of a copier, a printer, a facsimile device, and a multi-function device.

* * * * *